US007581815B2

(12) United States Patent
Silverbrook

(10) Patent No.: US 7,581,815 B2
(45) Date of Patent: Sep. 1, 2009

(54) PRINTHEAD ASSEMBLY WITH TWO-MATERIAL SUPPORTING STRUCTURE

(75) Inventor: Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 0 days.

(21) Appl. No.: 11/834,635

(22) Filed: Aug. 6, 2007

(65) Prior Publication Data

US 2007/0268334 A1 Nov. 22, 2007

Related U.S. Application Data

(63) Continuation of application No. 11/048,822, filed on Feb. 3, 2005, now Pat. No. 7,270,396, which is a continuation of application No. 10/713,076, filed on Nov. 17, 2003, now Pat. No. 6,869,167, which is a continuation of application No. 10/129,434, filed as application No. PCT/AU01/00238 on Mar. 6, 2001, now Pat. No. 6,659,590.

(30) Foreign Application Priority Data

Mar. 6, 2000 (AU) ..... PQ6059

(51) Int. Cl.
*B41J 2/155* (2006.01)
*B41J 2/14* (2006.01)

(52) U.S. Cl. ..... 347/42; 347/49

(58) Field of Classification Search ..... 347/42, 347/49

See application file for complete search history.

(56) References Cited

U.S. PATENT DOCUMENTS

| | | | | |
|---|---|---|---|---|
| 4,777,583 | A | 10/1988 | Minami et al. | |
| 4,829,321 | A | 5/1989 | Iizuka et al. | |
| 5,528,272 | A | 6/1996 | Quinn et al. | |
| 6,250,738 | B1 | 6/2001 | Waller et al. | |
| 6,322,206 | B1 * | 11/2001 | Boyd et al. | 347/85 |
| 6,428,145 | B1 | 8/2002 | Feinn et al. | |
| 6,984,022 | B2 | 1/2006 | Silverbrook | |

FOREIGN PATENT DOCUMENTS

| | | | |
|---|---|---|---|
| EP | 0566116 | A | 10/1992 |
| EP | 0566116 | A | 10/1993 |
| EP | 0646466 | A | 4/1995 |
| EP | 1043158 | A2 | 10/2000 |
| JP | 10128974 | A | 5/1998 |
| JP | 10181015 | | 7/1998 |
| JP | 10181015 | A | 7/1998 |
| WO | WO 99/65609 | A | 12/1999 |

* cited by examiner

*Primary Examiner*—Julian D Huffman

(57) ABSTRACT

The present invention relates to a printhead assembly. The printhead assembly includes a support beam. The support beam includes two types of material having different coefficients of thermal expansion. A plurality of spaced apart printhead modules is supported by the support beam.

4 Claims, 2 Drawing Sheets

PRINTHEAD ASSEMBLY WITH TWO-MATERIAL SUPPORTING STRUCTURE

CROSS REFERENCE TO RELATED APPLICATION

The present application is a Continuation of U.S. application Ser. No. 11/048,822 filed on Feb. 3, 2005, now issued U.S. Pat. No. 7,270,396, which is a Continuation of U.S. application Ser. No. 10/713,076 filed on Nov. 17, 2003, now issued U.S. Pat. No. 6,869,167, which is a Continuation of U.S. application Ser. No. 10/129,434 filed on May 6, 2002, now issued U.S. Pat. No. 6,659,590, which is a 371 of PCT/AU01/00238 filed on Mar. 06, 2001, the entire contents of which are herein incorporated by reference.

FIELD OF THE INVENTION

The present invention relates to modular printheads for digital printers and in particular to pagewidth inkjet printers.

CO-PENDING APPLICATIONS

Various methods, systems and apparatus relating to the present invention are disclosed in the following co-pending applications filed by the applicant or assignee of the present invention on 24 May 2000:

| | | | |
|---|---|---|---|
| PCT/AU00/00578 | PCT/AU00/00579 | PCT/AU00/00581 | PCT/AU00/00580 |
| PCT/AU00/00582 | PCT/AU00/00587 | PCT/AU00/00588 | PCT/AU00/00589 |
| PCT/AU00/00583 | PCT/AU00/00593 | PCT/AU00/00590 | PCT/AU00/00591 |
| PCT/AU00/00592 | PCT/AU00/00584 | PCT/AU00/00585 | PCT/AU00/00586 |
| PCT/AU00/00594 | PCT/AU00/00595 | PCT/AU00/00596 | PCT/AU00/00597 |
| PCT/AU00/00598 | PCT/AU00/00516 | PCT/AU00/00517 | PCT/AU00/00511 |

Various methods, systems and apparatus relating to the present invention are disclosed in the following co-pending application, PCT/AU/0001445 filed by the applicant or assignee of the present invention on 27 Nov. 2000. The disclosures of these co-pending applications are incorporated herein by cross-reference. Also incorporated by cross-reference, is the disclosure of a co-filed PCT application, PCT/AU01/00239 (deriving priority from Australian Provisional Patent Application No. PQ6058).

BACKGROUND OF THE INVENTION

Recently, inkjet printers have been developed which use printheads manufactured by micro electro mechanical systems (MEMS) techniques. Such printheads have arrays of microscopic ink ejector nozzles formed in a silicon chip using MEMS manufacturing techniques.

Printheads of this type are well suited for use in pagewidth printers. Pagewidth printers have stationary printheads that extend the width of the page to increase printing speeds. Pagewidth printers are able to print more quickly than conventional printers because the printhead does not traverse back and forth across the page.

To reduce production and operating costs, the printheads are made up of separate printhead modules mounted adjacent each other on a support beam in the printer. To ensure that there are no gaps or overlaps in the printing, it is necessary to accurately align the modules after they have been mounted to the support beam. Once aligned, the printing from each module precisely abuts the printing from adjacent modules.

Unfortunately, the alignment of the printhead modules at ambient temperature will change when the support beam expands as it heats up to the operating temperature of the printer. Furthermore, if the printhead modules are accurately aligned when the support beam is at the equilibrium operating temperature of the printer, then unacceptable misalignments in the printing may occur before the beam reaches the operating temperature. Even if the printhead is not modularized thereby making the alignment problem irrelevant, the support beam and printhead may bow and distort the printing because of the different thermal expansion characteristics.

SUMMARY OF THE INVENTION

Accordingly, the present invention provides a composite printhead supporting structure for a pagewidth printhead assembly having a plurality of printhead modules with a predetermined coefficient of thermal expansion, the modules being disposed along a length of the supporting structure, the structure comprising:

a composite beam elongated in the direction of the printhead and being at least as long as the printhead, the beam comprising segments bonded together end to end, at least one of the segments comprising material that is different from the materials of the other segments, wherein:

the materials have coefficients of thermal expansion different from that of the printhead modules, the coefficients of thermal expansion and the size of the segments being such that the printhead spacing, or printhead pitch, has an effective coefficient of thermal expansion substantially equal to that of the printhead modules.

Preferably, the effective coefficient of thermal expansion of the printhead modules is substantially equal to that of silicon.

The present invention also provides a printhead assembly for a printer, the printhead assembly including:

an elongate support member for attachment to the printer;

a printhead adapted to mount the support member, the printhead having and array of ink ejector nozzles formed in a substrate material; wherein, the support member is formed from a plurality of different materials having different coefficients of thermal expansion and configured such that the effective coefficient of thermal expansion of the support member is substantially equal to the coefficient of thermal expansion of the substrate material.

In some embodiments, the support member is a laminar beam with any odd number of longitudinally extending layers of at least two different materials wherein layers of the same material are symmetrically disposed about the central layer. In a particularly preferred form, the laminar beam has three longitudinally extending layers where the two outer layers are a first material and the central layer is a second material.

In other embodiments, the printhead is made up of a plurality of printhead modules adapted to mount to the support member at respective mounting points spaced along the support member; and the support member is a composite beam made up of segments of at least two different materials arranged end to end, wherein, between any two of the mounting points of the printhead modules there is at least part of at least two of the segments such that the effective coefficient of thermal expansion of the support member between the points is substantially equal to the coefficient of thermal expansion of the substrate material.

Preferably, the substrate material is silicon and the arrays of ink ejector nozzles are formed using MEMS techniques.

In some preferred forms, one of the materials is invar, and at least one of the other materials has a coefficient of thermal expansion greater than that of silicon.

It will be appreciated that the use of a composite support member made from at least two different materials having different coefficients of thermal expansion provide an effective coefficient of thermal expansion that is substantially the same as silicon.

Forming the composite beam by bonding different segments of material end to end will prevent bowing as long as the segment combinations repeat in accordance with the module mounting 'pitch' or spacing. Each combination of different materials extending between the mounting points of the printhead modules must have generally the same effective coefficient of thermal expansion as silicon. Simply ensuring that the effective coefficient of thermal expansion of the whole beam is about the same as silicon will not ensure that the modules remain aligned as the coefficient between any two adjacent mounting points may be higher or lower than silicon, thus causing misalignment.

BRIEF DESCRIPTION OF THE DRAWING

A preferred embodiment of the invention will now be described, by way of example only, with reference to the accompanying drawing in which.

DETAILED DESCRIPTION OF THE PREFERRED EMBODIMENT

Figure 1:
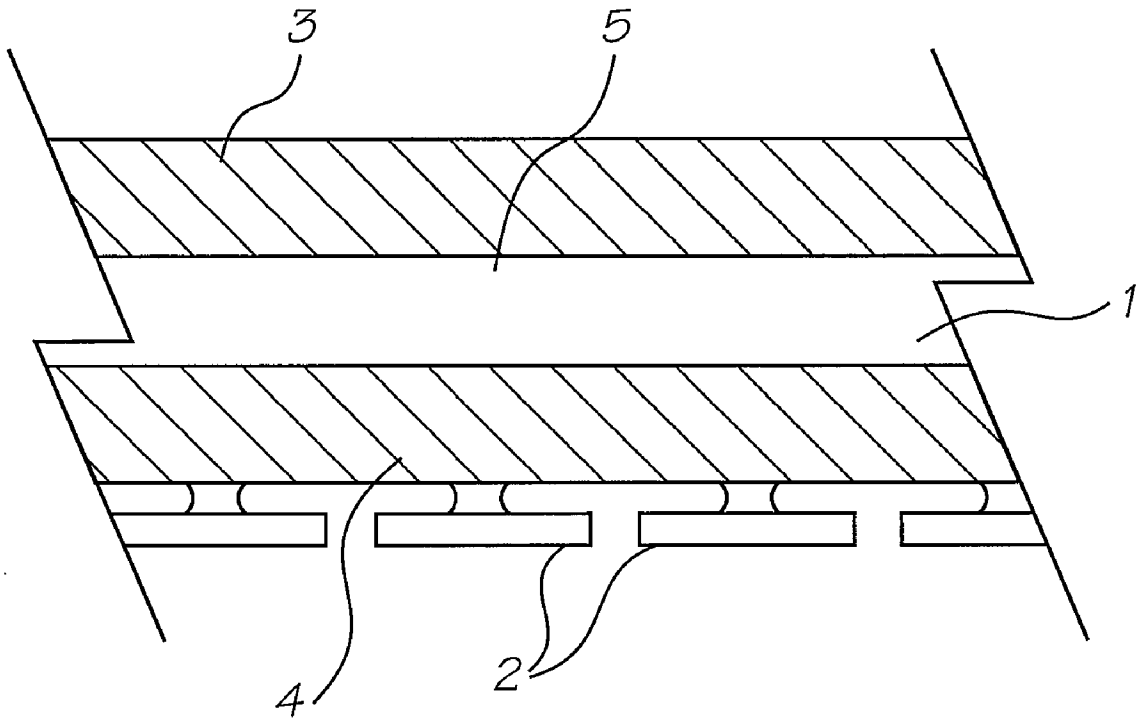
FIG. 1 is a schematic longitudinal cross section of a first embodiment of a printhead assembly according to the present invention; and, FIG. 2 is a schematic longitudinal cross section of a second embodiment of a printhead assembly according to the present invention.

Referring to FIG. 1, the printhead assembly has a support beam 1 supporting a plurality of printhead modules 2 each having a silicon MEMS printhead chip. The support beam 1 is a hot rolled three-layer laminate consisting of two different materials. The outer layers 3 and 4 are formed from invar which typically has a coefficient of thermal expansion of about $1.3\times10^{-6}$ meters per degree Celsius. The coefficient of thermal expansion of silicon is about $2.5\times10^{-6}$ meters per degree Celsius and therefore the central layer 5 must have a coefficient of thermal expansion greater than this in order to give the support beam as a whole a coefficient of thermal expansion substantially equal to that of silicon.

It will be appreciated that the effective coefficient of thermal expansion of the support beam will depend on the coefficient of thermal expansion of both metals, the Young's Modulus of both metals and the thickness of each layer. In order to prevent the beam from bowing, the outer layers 3 and 4 should be the same thickness.

Figure 2:
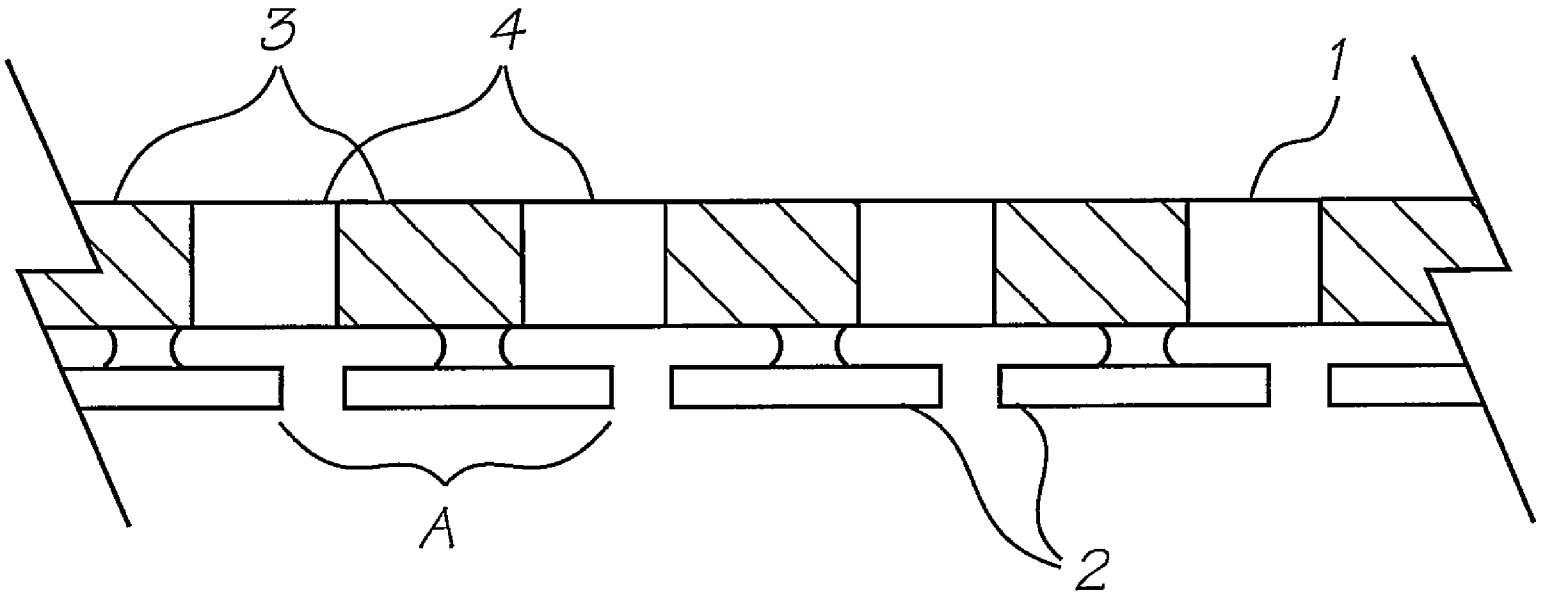

Referring to FIG. 2, the printhead assembly shown as an elongate support beam 1 supporting the printhead modules 2. Each printhead module has a silicon MEMS printhead chip.

The support beam 1 is formed from two different materials 3 and 4 bonded together end to end. Again, one of the materials has a coefficient of thermal expansion less than that of silicon and the other material has one greater than that of silicon. The length of each segment is selected such that the printhead spacing, or printhead pitch A, has an effective coefficient of thermal expansion substantially equal to that of silicon.

It will be appreciated that the present invention has been described herein by way of example only. Skilled workers in this field would recognize many other embodiments and variations which do not depart from the scope of the invention.

The invention claimed is:

1. A printhead assembly comprising:

a support beam including two types of material having different coefficients of thermal expansion; and a plurality of spaced apart printhead modules supported by the support beam, wherein the support beam is a hot rolled, three-layer laminate, the outer layers of the three-layer laminate being formed from Invar, and a central layer of the three-layer laminate has a coefficient of thermal expansion greater than Invar, whereby the support beam has an overall coefficient of thermal expansion substantially equal to that of silicon.

2. A printhead assembly as claimed in claim 1, wherein the outer layers are of the same thickness.

3. A printhead assembly as claimed in claim 1, wherein the support beam is formed from two different materials bonded together, end to end.

4. A printhead assembly as claimed in claim 3, wherein one of the materials has a coefficient of thermal expansion less than that of silicon and the other material has a coefficient of thermal expansion greater than that of silicon.

* * * * *